US007234605B1

(12) United States Patent
Torgerson

(10) Patent No.: US 7,234,605 B1
(45) Date of Patent: Jun. 26, 2007

(54) LOGGING GRAPPLE CARRIAGE

(76) Inventor: Lincoln Torgerson, 24178 Gunderson Rd., Mt. Vernon, WA (US) 98273

( * ) Notice: Subject to any disclaimer, the term of this patent is extended or adjusted under 35 U.S.C. 154(b) by 77 days.

(21) Appl. No.: 11/051,117

(22) Filed: Feb. 4, 2005

Related U.S. Application Data

(60) Provisional application No. 60/542,318, filed on Feb. 4, 2004.

(51) Int. Cl.
*B66C 21/10* (2006.01)

(52) U.S. Cl. ..... 212/84; 212/83

(58) Field of Classification Search ..... 212/83–84
See application file for complete search history.

(56) References Cited

U.S. PATENT DOCUMENTS 3,022,747 A * 2/1962 McIntyre ..... 104/178
3,540,770 A 11/1970 Mitchell
3,647,255 A 3/1972 Hale et al.
3,972,420 A * 8/1976 Stock et al. ..... 212/285
4,515,281 A 5/1985 Maki
5,020,443 A * 6/1991 Gauthier ..... 104/230
5,088,610 A 2/1992 Garnier
5,653,350 A 8/1997 Maki
6,237,502 B1 * 5/2001 Van Damme ..... 104/173.1
2004/0129662 A1 * 7/2004 Baker ..... 212/94

* cited by examiner

*Primary Examiner*—Thomas J Brahan
(74) *Attorney, Agent, or Firm*—Michael F. Hughes; Hughes Law Firm, PLLC

(57) ABSTRACT

A grappling carriage that is relatively lightweight and adapted to forcefully close first and second grapple legs with a log or a bundle of logs contained therein. The grappling carriage has a self-contained power supply that is remotely controlled by the operator. The grappling carriage is sufficiently lightweight to operate in a variety of cabling topographies given the relatively lighter weight of the unit.

29 Claims, 6 Drawing Sheets

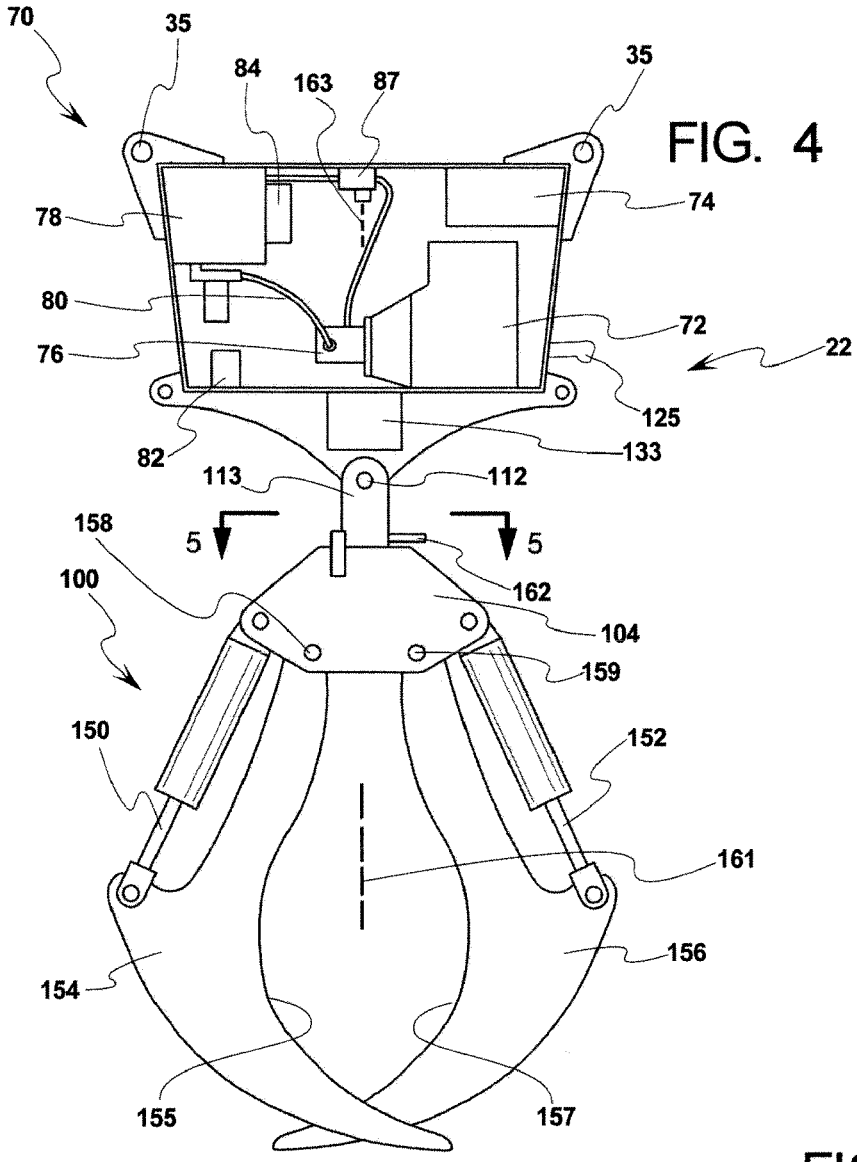
FIG. 4
FIG. 5
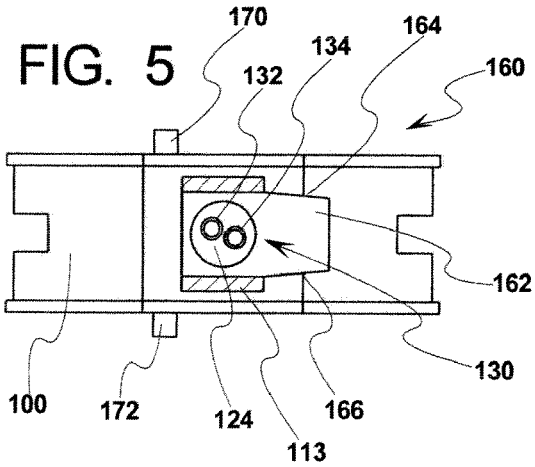
FIG. 6
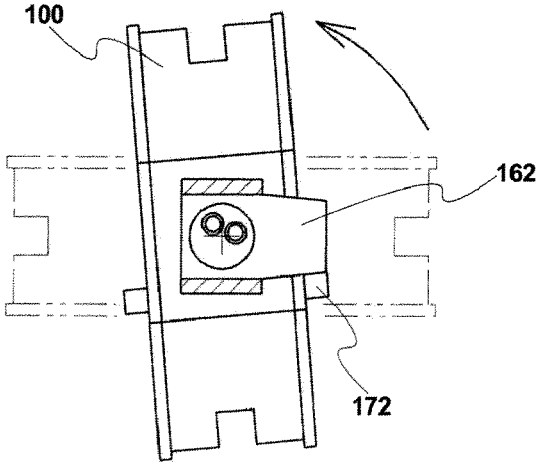

LOGGING GRAPPLE CARRIAGE

RELATED APPLICATIONS

This application claims priority benefit of U.S. Ser. No. 60/542,318, filed Feb. 4, 2004.

BACKGROUND OF THE INVENTION

In general, the logging climate has changed in the past several decades, in that logging regulations and protocol have mandated taking more of the logs out of the logged portions out of the woods. For example, in years past, loggers would not bother with anything under 12–16 inches, whereby only the larger, old-growth timber was taken out of the forest and used for industrial processing for a variety of wood-related products. However, the climate has drastically changed whereby now every aspect of the logs which can reasonably economically be removed are taken from logging sites. Therefore, in essence, at the time of this invention, any log which can be properly de-limbed and economically removed is removed from the site. This changes the dynamics of log removal from the logging area, whereby many of the smaller trees (as well as the larger ones) must be removed from the logging area and taken to a central landing area for immediate processing or otherwise referred to as "manufacturing" in logging vernacular.

Therefore, to meet the demands of the present logging operations, it is desirable to have an apparatus which can operate in a logging job and which can accommodate the wide variety of logs which is required to be extracted, and further which can be adapted to cover a very large radius and have the ability to extend over a great range to extract logs to a central landing area for manufacturing. Further, this generally requires powered actuators and a mobility system to accommodate these high demands. In addition to the technical requirements and the new logging environment for which logging operations now exist, there are additional considerations of increasing the safety for loggers who are oftentimes injured or "busted up" in the field. It is therefore desirable to have a unit which can execute the job of extracting the logs from the logging area to a central area without putting many loggers in harm's way by setting chokers or having to be near the unit for operation. In addition, an apparatus which can be retrofitted to any number of cable topographies, is particularly advantageous. As described herein below, the various prior art devices lack the versatility to be implemented in a variety of cabling arrangements which are described in the figures below.

The teachings of U.S. Pat. No. 5,653,350 (Maki) discloses a grapple carriage which is essentially only suitable for a "skyline" cable arrangement. In general, a unit such as this is fairly large and heavy, and can weigh thousands of pounds and the weight would be in excess to use any other method than the skyline cable topography.

The other prior art references, such as Hale U.S. Pat. No. 3,647,225, and Mitchell U.S. Pat. No. 3,540,770, are units which are particularly conducive for very large logs such as old growth timber. The jaws, which essentially are non-actuated or have very limited actuating ability, are primarily fed by the gravity of the unit. This is not reliable for smaller logs or, in particular, bundles of logs where you need actuating jaw clamps to contain those logs as a unit for haul back.

SUMMARY OF THE INVENTION

A grappling carriage adapted to be run by an operator and lift a bundle of logs in a logging operation from the field to a landing area, the grappling carriage comprises an upper carriage assembly and an grapple assembly. The upper carriage assembly comprises an engine system having a self-contained fuel supply and a a hydraulic drive system operatively connected to the engine system and comprising hydraulic lines adapted to have pressurized hydraulic fluid pass therethrough. The grapple assembly comprising first and second grapple legs having interior surfaces adapted to engage the bundle of logs in a logging operation pivotally connected to a grapple body. The grapple assembly has a center of gravity positioned under the upper carriage assembly and further comprises an actuating system comprising an actuator adapted to position the first and second grapple legs to an open position and forcefully position the first and second grapple legs to a closed position. The grapple assembly further has a rotating actuator adapted to rotate the grapple body with respect to the upper carriage assembly. There is further a control system adapted to receive signals from the operator to adjust the first and second grapple legs and rotation of the grapple assembly with respect to the upper carriage assembly. The grappling carriage is sufficiently lightweight to operate in logging cable topographies such as a haul back, skyline or running skyline arrangement.

BRIEF DESCRIPTION OF THE DRAWINGS

FIG. 4 is a front partial sectional view of the grappling carriage in a operating orientation;

FIG. 5 is a top sectional view taken along line 5—5 of FIG. 4 of the swivel assembly;

FIG. 6 shows the grapple assembly rotating with respect to the upper carriage assembly.

DETAILED DESCRIPTION OF THE PREFERRED EMBODIMENT

In general, there will first be a discussion of a logging cable topography that the grappling carriage is adapted to operate. Thereafter, there will be a detailed discussion of one preferred form of the grappling carriage.

Figure 1:
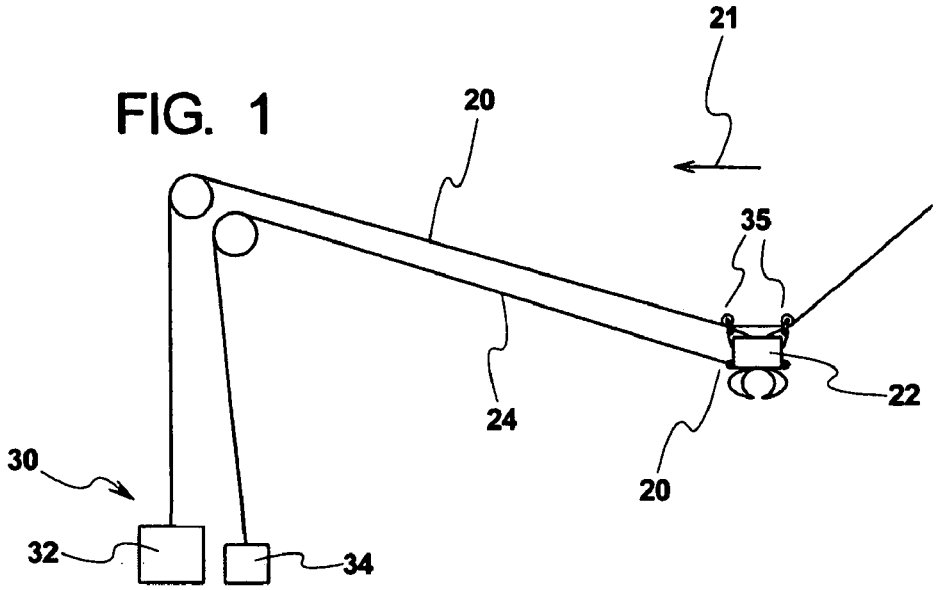
FIG. 1 shows a schematic view of a skyline cable topography in a logging operation.

FIG. 1 shows a logging topography where a skyline method is shown having a main line or a skyline indicated at 20 and the apparatus 22 pivotally attached thereto with a pulley system 35. The line indicated at 24 is referred to as a skidding or haul back line. The skidding line 24 is connected to the device 22 at location 26. The drum location 30 has a first drum indicated at 32 which takes in and lets out the main line 20. This controls the height of the apparatus 22 with respect to the ground. The second drum indicated at 34 controls the haul back which positions the apparatus 22 in the longitudinal direction indicated at 21 along the whole logging unit.

Figure 2:
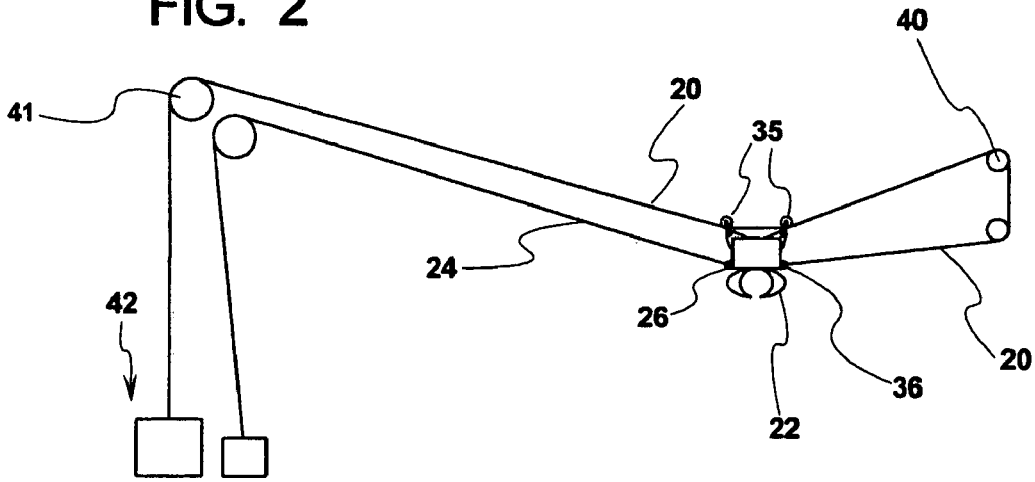
FIG. 2 shows a schematic view of a running skyline cable topography in a logging operation.

As shown in FIG. 2 is a second logging method or cable topography which the present invention can be employed. FIG. 2 shows a running skyline method. This method is particularly of interest because many prior art devices are too heavy to be employed in this method. As shown in FIG. 2 the apparatus 22 is connected to the haul back 20 through a pulley support block system 35. The other end of the haul back is connected to the apparatus at the location indicated at 36. The main line 24 is also connected to the opposing side of the apparatus 22 at location 26. It should be noted that in FIG. 2, the cable denoted as numeral 20 is actually the haul back cable. In general the haul back cable is of smaller diameter (between ¾" to ⅞"). The reason a smaller cable is used is because the length of the cable 20 in FIG. 2 will have to extend over twice the length of the logging area which logs are retrieved. For example, if there is a thousand feet between the anchor points 40 and the yarding location indicated at 42, then approximately 2400 feet of cable 20 must be employed. This requires a larger drum and the drums are of limited size in the environment where the invention is employed. Therefore, the cable indicated at 24 is generally a thicker cable and the skyline cable as indicated at numeral 20 in FIG. 1 is normally the cable that is employed for that purpose. It should be noted that a breaking system is used at the yarding base 42 so tension is constantly applied to the cables 20 and 24. If tension was not constantly applied to either one of these tables the apparatus 20 would simply fall to the ground.

In the topography as shown in FIG. 2, the hall back cable 20 essentially allows the unit 22 to be elevated and raised from the ground. The mainline cable 24 is adapted to pull the unit 22 inwardly to the landing, which is presumably somewhat near the actuating units 42. It should be further noted that this topography is particularly useful for hauling loads inwardly out from the field into the landing area, and the equipment is simply not set up to haul a heavy load back out into the logging area field for the extraction of the logs. To place the unit out away from the area for extraction of the logs, the running skyline essentially serves two purposes, where the hall back line 20 is provided with an angle and the two support pulley points 35 provide lift for the unit 22, so that when tension is applied, the lateral tension on the device will pull it out into the field. If the unit 22 is heavy, say 5000–6000 pounds, this essentially puts more strain on the cables and the system. Further, when a load is upon the grapple unit 22, if the grapple unit is an order of magnitude heavier (such as 4000–6000 pounds versus 2000–3000 pounds), this severely limits the amount of logs which can be taken in from the mainline 24.

It should be noted that because a smaller cable must be used for the running skyline method, having a lighter apparatus 22 will facilitate the logging and extraction method and in fact is the only type of apparatus that can be employed in such a logging method. It should also be noted that the running skyline as shown in FIG. 2 is particularly conducive in certain operations where the pulley support 40 is elevated with respect to the pulley support unit 41. In other words, there has to be a tensioning member within the cable portion indicated at 20' to lift the unit 22 up the hill, as well as to prevent the unit 22 from crashing down towards the actuating units 42 by virtue of gravity.

Figure 3:
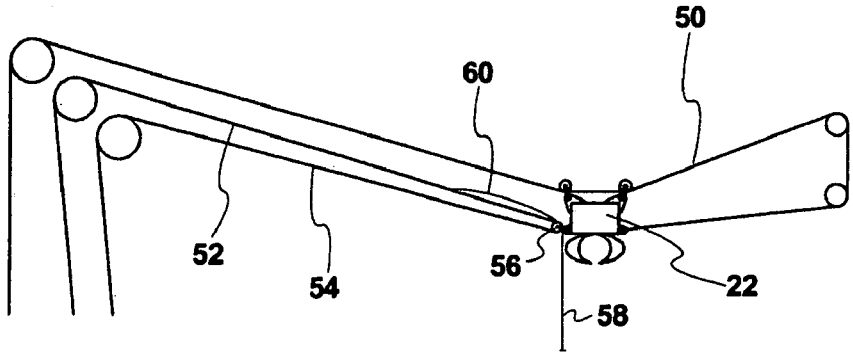
FIG. 3 shows a modification to the running skyline cable topography where a drop line is employed.

Now referring to FIG. 3, we have a drop line method. This method employs a haul back cable indicated at 50 which is generally similar to the haul back cable 20 in FIG. 2. Cable portion 52 indicate a top main line and portion 54 indicates bottom line portion. Cables 52 and 54 are the same cable and attached to a pulley 56 which is attached to the apparatus 22. This method allows for a drop line 58 to be employed where a combination of tension applied to the cables 52 and 54 will allow lowering of the cable 58. It should be noted that a ratcheting system is employed so the cable will not droop or hang at the central location indicated at 60. This logging method allows for presetting to be used where the drop line 58 is attached to a bundle of logs that has a chocker set there around. This allows for convention when not employing the carriage for whatever reason such as a malfunction or if the situation otherwise calls for a conventional logging to be employed.

It should be noted that the apparatus is particularly conducive for interfacing with equipment which is designed and formed to work in environments that are substantially different. For example, yarders, some of which have limited capabilities in hauling weight and extending cable lengths, are generally adapted for a choker setting system, whereby chokers are set by loggers in the field. It should be noted that there does not have to be a yarder at the landing, but rather any kind of machine or any type of actuator which is adapted to manipulate the length of a cable. At any rate, the apparatus 22 does not require the setting of chokers which can be hazardous to the logger in the field. It should be further noted that any machine that can work and run cables can be retrofitted to use the grapple carriage. It should be further noted that the apparatus 22 is particularly conducive which operations which are referred to as "one end suspend." This is a situation where one end of a log is suspended and the other end drags and is partially supported by the ground. The apparatus is also conducive when in the case of an obstruction, such as a stump, the support cable 20 (shown in FIGS. 1 and 2) can be tensioned slightly to raise the unit up and above the stump. It should be noted that upper carriage component 70 (see FIG. 4) is adapted to be positioned and not rotate which would change the position of the grappling carriage 22 by way of tensioning the main line and haul back cables. In other words, the rotation is executed by the grapple assembly 100 and during such rotation, the upper carriage component 70 remains substantially positionally orientated with the supporting cables (main line and haul back).

There will now be a discussion of the grappling carriage 22 with initial reference to FIG. 4, there is shown an upper carriage component 70 and a grapple assembly 100. The upper carriage compartment 70 houses and fully contains all the main functional components of the grappling carriage 22. The engine 72 is generally diesel type internal combustion engine. In one form the engine 72 is a ten-horse power air-cooled engine. In other forms a twelve horse power or smaller engine can be employed. The main function of the engine is to operate the hydraulic unit and potential other peripheral items, such as lights. In the future, lighter engines with higher horsepower will be available, such as potentially 16 horsepower, which is equivalent to 10-horsepower units at the time of filing this application. The unit can operate with a relatively lightweight lower horsepower engine than other prior art forms. At any rate, in one best mode of making, a 10-horsepower engine provided adequate velocity of the hydraulic units and power associated therewith to operate the unit as prescribed. It should be noted that a relatively smaller horse power engine can be used that is lighter than a larger engine where by motion of the grappling carriage 22 is conducted by the tension exerted upon the logging cables as shown in FIGS. 1–3. In one configuration, positioned above the engine 72 is a fuel tank 74. The unit does not have to be fitted for a non-vertical orientation since the carriage 22 will always hang below the cable supporting the same. The engine 72 is operatively connected to a variable displacement hydraulic pump schematically shown at 76. In general the rotating member output shaft of the engine 72 is coupled to receiving the component of the hydraulic pump 76. The function of the pump is to flow hydraulic fluid therethrough and elevate the pressure of the hydraulic fluid. The hydraulic pump 76 in one form is a positive displacement variable flow pump such as a gear pump or piston pump. The main functional operation to the pump is to increase the pressure of the hydraulic fluid passing there through and supply sufficient volume to operate the various hydraulic components. The hydraulic tank 78 is essentially a sump supplying hydraulic fluid through line 80 to the hydraulic pump 76. Also encased within the housing is a battery 82 used to start the engine 72 and a hydraulic valve system discussed below. Further enclosed in the upper carriage compartment 70 of the apparatus 22 is a control system 84 comprising a remote controlled having a logic and circuitry contained therein to operate the operative aspects of the apparatus 22.

As shown in FIGS. 5 and 6 the stop system 160 is shown. In general an extension 162 is rigidly attached to the carriage assembly 70 as shown in FIG. 4 and more specifically the extension is attached to the pivot coupler 113. The pivot coupler 113 is pivotally attached at the pivot pin 112 to the upper carriage assembly 70 (see FIG. 4). The extension 162 has lateral side portions 164 and 166 that are adapted to engage stops 170 and 172 where as shown in FIG. 6, the extension 172 is engaged with the extension 162 to limit the amount of rotation of the grapple assembly 100 with respect to the carriage assembly 70.

Figure 8:
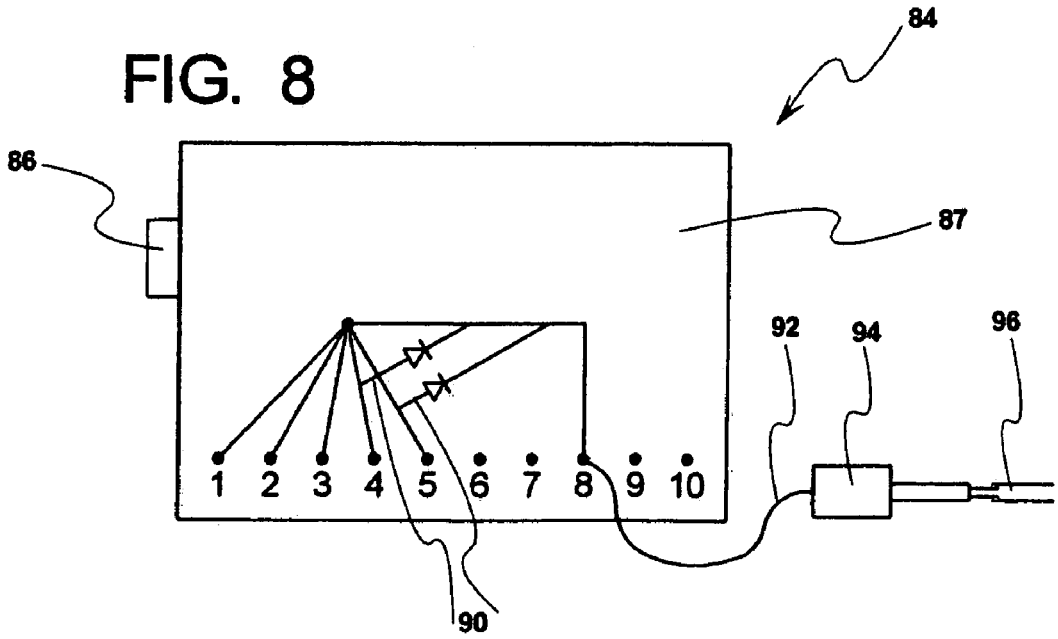
FIG. 8 is a schematic view of a remote controlled receiver that is adapted to control the log carrying apparatus.

There will now be a discussion of the remote controlled receiver 84 with reference to FIG. 8. In essence, the remote controlled receiver is adapted to receive radio frequency signals to operate the various components of the apparatus 22. As shown in FIG. 8 the remote controlled receiver 84 comprises of an antenna receptor or self contained antenna 86 that is of such length to receive signals from anywhere in the logging area. A most preferred form is the use of an RF transmission to control the unit, where cabling is somewhat challenging to employ. Of course, a variety of frequency modulation schemes that are known at the time can be used, such as analog and digital signaling systems to control the unit 22. It should be noted that there can be more than one transmitter sending signals. For example, the yarder engineer may have a transmitter to send signals and the ground man (or otherwise referred to as a spotter) can additionally have a transmitter to send signals to control the apparatus 22. In one form, there are eight channels to operate the apparatus 22. Each channel can correspond to a frequency range or any other frequency modulation scheme that can properly send signals to the remote controlled receiver 84. Referring to the left-hand portion of FIG. 8, two channels are employed where each one respectively opens and closes the grapple. The opening and closing of the grappling legs is accomplished with a dual actuating piston described below. Two additional channels are employed which are used mutually exclusive (as with the previous two channels) to rotate the lower grapple assembly 100 right or left. An additional channel is used for starting the engine. In a most preferred form, an actuator controlled by one of the channels controls an idle solenoid which directly shut off the fuel supply to the fuel injection portion of the diesel engine. Alternatively, a fuel shut off and shut on which is in a toggle format to disengage and engage the fuel line to the engine 72. Having a fuel shut off is advantageous where the orientation of the apparatus 22 is such there may be a leakage or drainage issue where the engine is getting flooded with fuel.

An optional control is provided for lights 125 as shown in FIG. 4 or other external devices. The lights 125 are optional and can provide illumination in early morning or later evening work. Further in Northern portions of the Earth during winter months, daylight can be scarce where illumination can be helpful for log extraction. In one form the 12-volts output signal can power lights directly. Alternatively, an alternator attached to the motor can be employed to provide additional amperage for higher-powered lights where the 12-volt signal would at least in part function as the control switch to turn on and off the lights. An additional line is used for an engine throttle. In one form the control line is somewhat unique whereas shown in the central portion of FIG. 8, diodes indicated at 90 are employed which are electrically connected to all of the lines 1 through 5 (only lines four and five are shown in FIG. 8). The diode allows electrical transmission to pass to line 8 which thereby passes through line 92 to an actuator such as a solenoid 94. The solenoid thereby activates the throttle which is schematically shown at 96. Therefore, whenever any of the actions are taken such as opening and closing the grapple or rotating the grapple, a control line is sent to the throttle to power up the engine to provide sufficient output power to operate the hydraulic motor 76 (or alternator in alternative embodiments).

Figure 7:
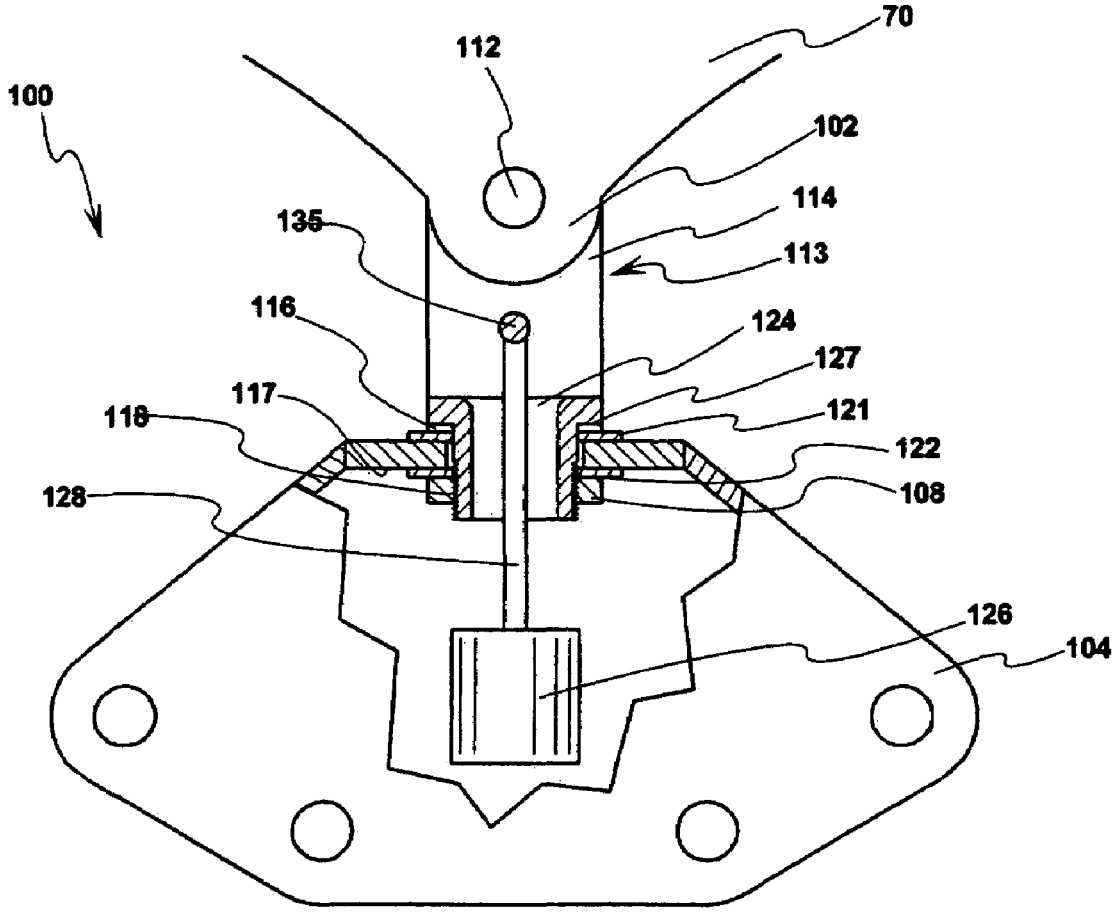
FIG. 7 is a partial sectional view of the grapple assembly.
Figure 7A:
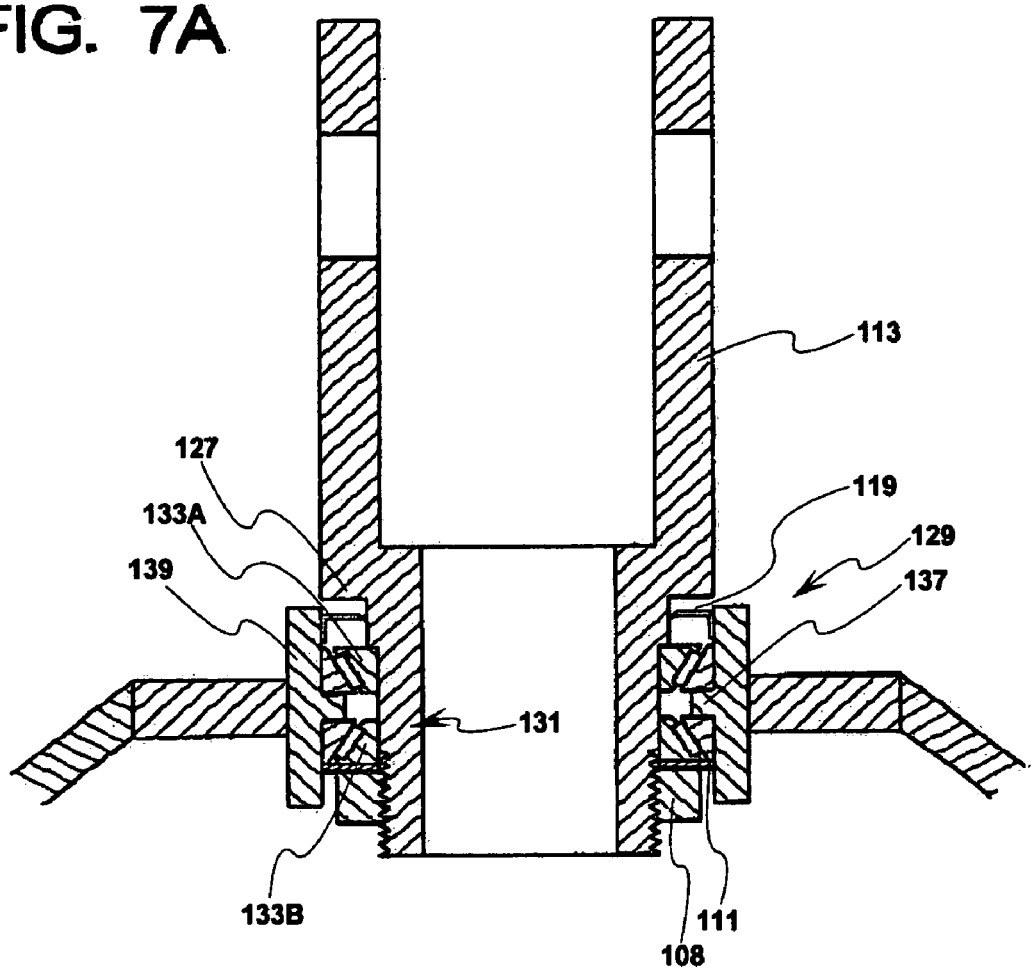
FIG. 7A shows an alternative bearing assembly.

Referring back now to FIG. 7, a portion of the grapple assembly 100 is shown. The grapple assembly 100 comprises a grapple body 104 that is pivotally connected to the upper grapple carriage 70 by the extension 102, and is pivotally attached thereto. The grapple body 104 is pivotally connected about a vertical axis to a swivel coupling 113. The swivel coupling 113 comprises upper shoulder regions 114 that are adapted to be mounted to the pivot pin 112. In a more preferred form the schematic bearings 121A and 122A are thrust bearings such as tapered bearings such as that as shown in FIG. 7A. In another form as shown in FIG. 7, two Teflon type washers are employed where one washer is attached to the surface of the shoulder 116 and is adjacent to the upper surface 117 of the grapple body. The second bearing could be washer indicated at 122 positioned beneath the grapple body and this second washer 122 is interposed between the upper surface 117 of the grapple body 104 and the nut 108 that is threadedly engaged to the swivel coupling 113. In one form, it is desirable to have a preload upon the Teflon surfaces so jarring and the like does not occur in operation.

In FIG. 7A a bearing structure 129, whereby a thrust bearings assembly 131 is used which in one form are tapered bearings applied to have a rotation but also handle the thrust. The thrust bearings on the upper and lower portions, so when the lower unit is in compression or tension, the unit can withstand such abuses. Interposed between the nut 108 and the thrust bearing assembly 131 is a washer seal 111 that is adapted to extend to the outer distal portion of the bearing 131 to hold the grease therein to the hub 115. In a like manner, a washer unit 119 is adapted to be held in place by the lower shoulder surface 127. The thrust bearing assembly 131 is comprised of upper and lower taper bearings 133A and 133B. The taper bearings 133A and 133B interface with a circular angle support 135A and 135B respectively. The circular angle supports 135A and 135B are adapted to engage the circular flange 137 of the support cylinder 139. The support cylinder 139 is fixedly attached to the upper surface 117 of the grapple body and in one form is welded thereto.

Referring to FIG. 7, central cavity regions 124 are used to allow hydraulic lines to pass therethrough. It is desirable to have the hydraulic lines contained therein and not externally exposed so they are not damaged in the rigorous operation for which the grappling carriage 22 is designed. The rotating actuator (hydraulic motor in a preferred form) 126 has a central shaft 128 that is operatively connected to the pivot coupler 113 at location 135. The outer housing of the motor 126 is operatively connected to the carriage assembly to provide rotation of the grapple assembly 100 with respect to the carriage assembly 70 positioned thereabove.

As shown in FIG. 5, the hydraulic lines 130 as mentioned previously passes between the cavity regions 124 of the pivot coupler and extends laterally as is divided to line pairs 132 and 134 and each line pairs 132 and 134 are actually two separate lines that can alternatively and are hydraulically pressurized in mutually exclusive fashion whereby line pairs 132 force the actuators 1501 and 152 (that are best seen in FIG. 4) are forcefully opened or alternatively forcefully closed in order to release a set of logs and clamp a set of logs. Line pairs 134 are adapted to be pressurized by the control system 84 in a mutually exclusive manner to rotate the rotating actuator 126 in either direction for rotation of the grapple assembly 100.

It should be noted that the internal Teflon washer 122 or taper bearing 122A are self-contained within the lower grapple body 104. This is advantageous because it is less susceptible to the elements such as bark, dust and debris which can cause premature wear of the bearing. It should also be noted that this internal washer in operation most of the time will be absorbing most of the load since there is a vertically downward load upon the grapple with the weight of the grapple assembly 100 and the grapple assembly 100 in combination with a load of logs. Setscrews can be employed with the washer 108 to lock it and have it removable and mechanically attached to the central threaded area 118. It should be further noted that in one form, the first and second actuators 150 and 152 comprise the actuating system to position the first and second grapple legs in an open and closed position. Of course, the actuating system is defined broadly, where at least one actuator is employed and by way of any form of linkage mechanism is adapted to open and close the first and second legs 154 and 156.

In general, the grapple legs 154 and 156 are pivotally connected to the grapple body 104 at pivot locations 158 and 159. The grapple legs 154 and 156 comprise interior surfaces 155 and 157 that are adapted to engage a log or a bundle of logs. It should be noted that in general, the grapple assembly 100 as shown in FIG. 4 has a center of gravity generally aligned along the axis 161. The center of gravity, which is positioned below the pivot pin 112, is generally below a center longitudinal axis 163 of the upper carriage assembly 70. Of course the center of gravity of the upper carriage assembly can alter depending upon the components contained therein. However, it should be noted that it is positioned between the pulley location points 35 as shown in FIG. 4 and the center gravity of the grapple assembly 100 is positioned in between the pulley point locations 35. As described further herein, the mass of the grapple assembly is fairly substantial as compared to the upper carriage assembly 70 whereby the upper carriage assembly 70 can be positioned in an upright position as shown in FIGS. 9A and 10.

Figure 11:
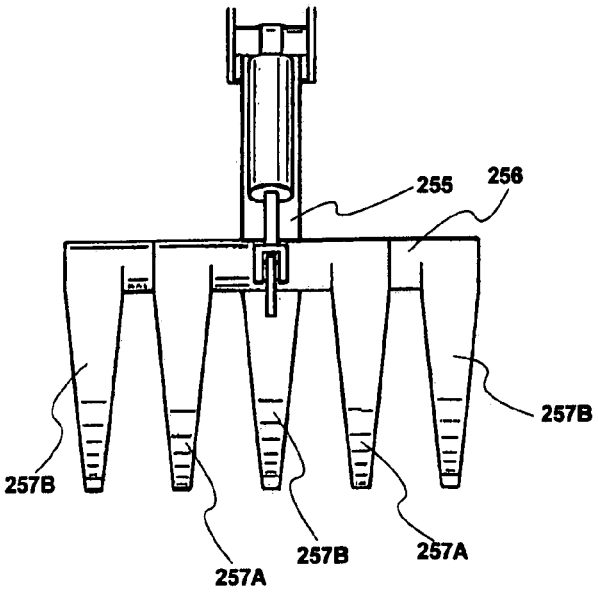
FIG. 11 shows a front view of another embodiment of grapple legs.
Figure 12:
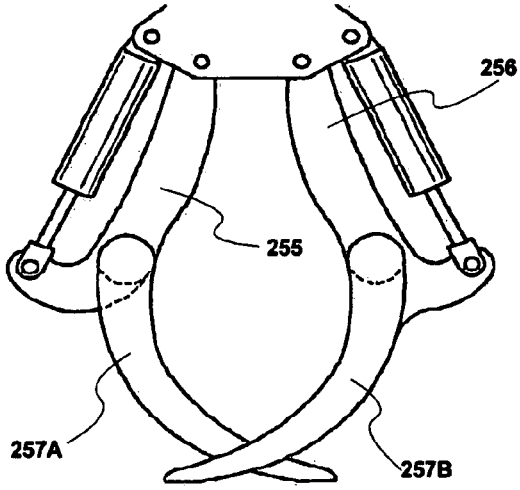
FIG. 12 shows a transverse view of the embodiment of grapple legs shown in FIG. 11.

FIG. 11 shows another configuration of grappling legs 255 and 256. In general, the grappling leg 255 comprises a plurality of tines 257A and 257B that could be employed in operations such as extracting logs, debris or the like from, for example, a body of water where the array of tines extend in a transverse direction perpendicular to the embodiment as shown in FIG. 12. In a preferred form the tines on each opposing leg will have an odd and even number of tines. As shown in FIG. 11 the tines 257A are positioned on grapple leg 255 and are positioned between tines 257B of grapple let 256. Of course any number of tines can be used on either grapple leg, but this is one preferred form.

It should be noted that a few of the more relevant features to draw attention to is that the grapple assembly 100 rotates with respect to the carriage assembly 70. This rotation is a powered rotation and is controlled operatively by either the yarder engineer or the ground spotter. The hydraulic jaws or actuators 150 and 152 as shown in FIG. 4, are forceful actuators that clamp the grapple legs forcefully so heavier loads can be carried and displaced from one location to another. Further, the whole unit is relatively light so as shown in FIG. 2, the running skyline method can be employed with a smaller cable such as a ¾ or ⅞ inch cable that will only hold a smaller payload than a larger cable. In another form, the grapple legs can be replaced with a rake like device where as shown in FIG. 4 the grapple legs may extend about an axis that is perpendicular to the plane of this front view. These rigs can be in one form deployed in a situation where material desired to be removed from a body of water such as a river logjam and a grapple leg rig type system is advantageous for grabbing multiple smaller sized objects for removal from the body of water.

Figure 9A:
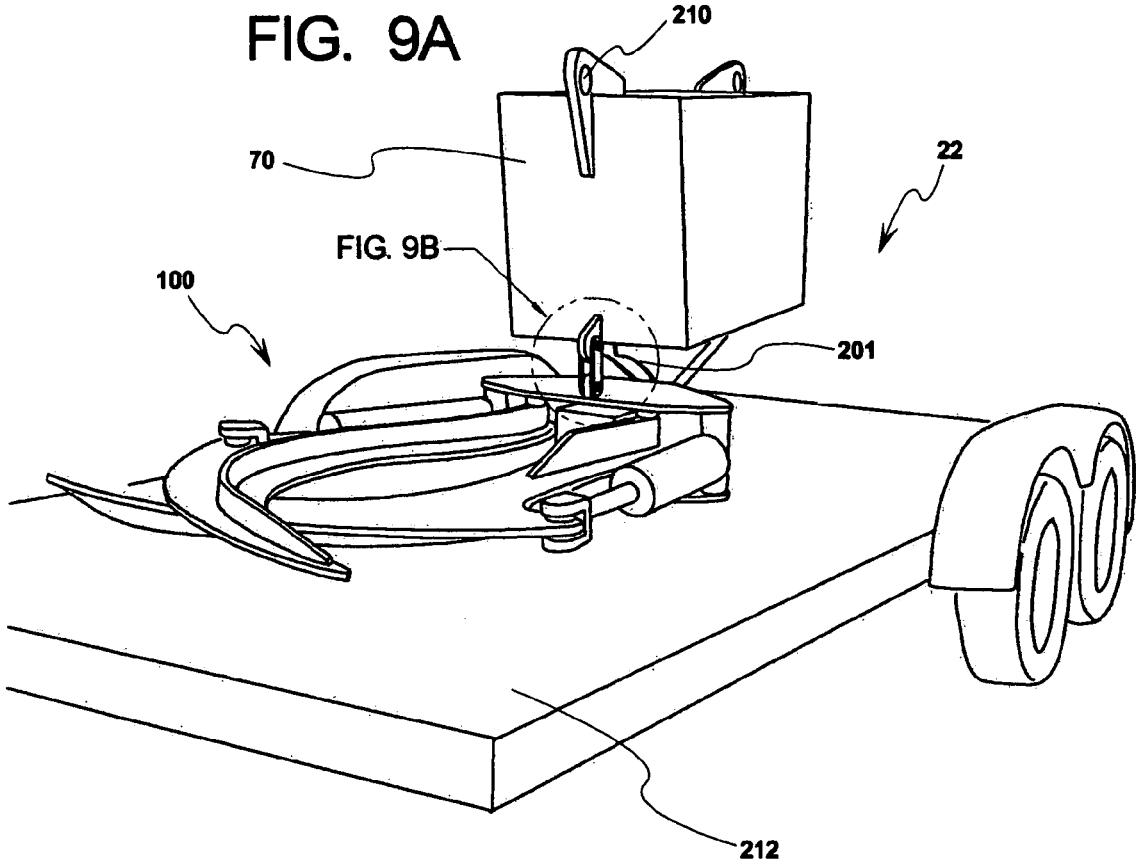
FIG. 9A discloses isometric view of the grappling carriage in a stored position.
Figure 9B:
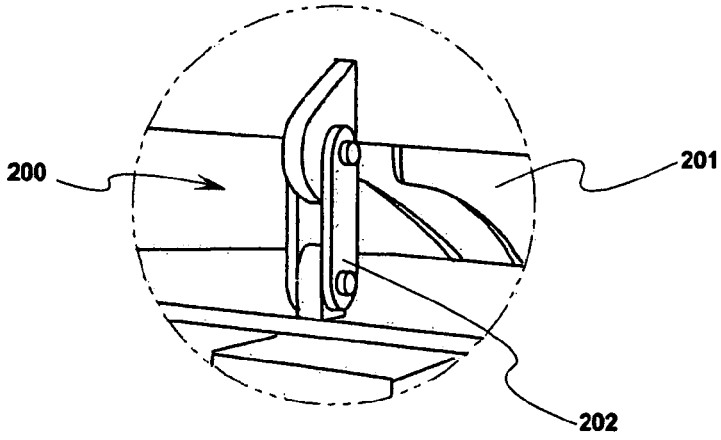
FIG. 9B shows a linking mechanism is adapted to say to you upper carriage assembly and upright position with respect to the lower grapple assembly.
Figure 10:
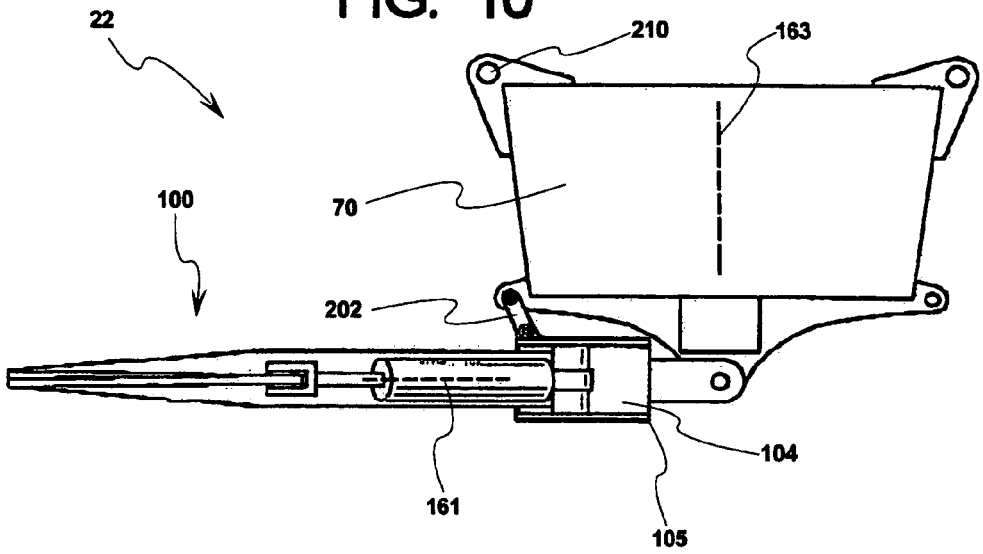
FIG. 10 shows the grappling carriage in a side view in a stored position illustrating how the center of gravity is adapted to keep the unit upright.

Further, as shown in FIGS. 9A, 9B and 10, the grappling carriage is in a storage state, whereby the center of gravity is positioned over the supports and a locking mechanism 200 locks the lower boom member to the upper housing assembly. Further, the attachment member 210 is positioned approximately over the center of gravity so that the unit can be lifted with ease, whereby there is a desirable amount of slight tilt so that the grapple legs will tilt upward a slight amount when the unit is lifted, which makes it easier for positioning and transporting the grapple carriage 22.

Therefore, the center of gravity position and the locking mechanism 200 as shown in FIG. 9B is advantageous for storing the unit, and further, it should be noted that the extension 162 (see FIG. 5), which is attached to the pivot coupler 113, is particularly well-suited to absorb some of the vertical load thereon and provide a laterally outward surface 164 or 166 to help prevent toppling. Further, the connection member 202 by way of attaching to the stop 170 or 172 of the lower grapple assembly 100 locks the upper housing in a vertical upright position for routine maintenance and other required actions taken upon the apparatus. The connection member 202 as shown in FIG. 9B can be helpful in that items that are removed from the carriage assembly 70 can adjust the overall center of gravity of the unit, and the connection member 202 prevents toppling of the carriage compartment 70. Further, the lower stop members 170 and 172 engage the upper rib portions 201 of the housing unit, which further stabilizes the upper housing unit in the stored position. Therefore, while the upper housing unit is in a substantially upright position, withheld by some sort of vertical support such as a cable with blocks attached thereto, the connection member 202, which in one form is an exterior piece that is interposed between the carriage compartment 70 and the grapple assembly 100 where two pins fasten the two members together in a conventional manner. This arrangement provides for a nice compact unit where the inward upper support opening portion can be used as a single point of contact where any kind of fastening member, such as a hook, can extend therethrough and maneuver the unit around such as to put it on a transport of some sort such as a trailer bed 212 or even on a truck bed for transportation.

As shown in FIG. 10 there is a side view of the carriage assembly 22 in a stored position. The center of gravity of the entire assembly is to the left of the support portion of the grappling body 104. The connection member 202 prevents the carriage assembly 70 from toppling in a clockwise manner and because the lower grapple assembly 100 has a significant amount of mass with respect to the upper carriage assembly 70, the net center of gravity of the grappling carriage 22 is safely to the left of the right most portion 105 of the grappling body 104. In one form the center axis 161 of the grapple assembly 100 is approximately within 70 to 110 degrees of the center axis 163 of the upper carriage assembly 70 as shown in FIG. 10.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A grappling carriage adapted to be run by an operator and lift a bundle of logs in a logging operation from the field to a landing area, the grappling carriage comprising:

a. an upper carriage assembly comprising:
   i. an engine system having a fuel supply,
   ii. a hydraulic drive system operatively connected to the engine system and comprising hydraulic lines adapted to have pressurized hydraulic fluid pass therethrough, b. a grapple assembly comprising first and second grapple legs having interior surfaces adapted to engage the bundle of logs in a logging operation pivotally connected to a grapple body, the grapple assembly having a center of gravity positioned directly under the upper carriage assembly and further comprising:
   i. an actuating system comprising actuators adapted to forcefully position the first and second grapple legs to an open position and forcefully position the first and second grapple legs to a closed position,
   ii. a rotating actuator adapted to rotate the grapple body with respect to the upper carriage assembly, c. a control system adapted to receive signals from the operator to adjust the first and second grapple legs and rotation of the grapple assembly with respect to the upper carriage assembly, d. whereas the grappling carriage is sufficiently lightweight to operate in logging cable topographies comprising from one or more of the following a haul back, skyline or running skyline arrangement.

2. The grappling carriage as recited in claim 1 whereby exterior lights are attached to the grappling carriage.

3. The grappling carriage as recited in claim 1 where the engine system comprises a diesel engine.

4. The grappling carriage as recited in claim 3 whereby the diesel engine is no more than a 12-horsepower engine.

5. The grappling carriage as recited in claim 1 whereby the actuating system comprises a first and second actuators independently controlling the first and second grapple arms respectively.

6. The grappling carriage as recited in claim 1 whereby the grappling carriage has an operating orientation where the grapple assembly is positioned directly under the upper carriage assembly and the grappling carriage has a stored position whereby a center axis of the grapple assembly is non-co-linear to a center axis of the upper carriage assembly.

7. The grappling carriage as recited in claim 6 whereby the center axis of the grappling assembly is substantially orthogonal to the center axis of the upper carriage assembly in the stored position.

8. The grappling carriage as recited in claim 6 whereby when the grappling carriage is in a stored position, the center axis of the grapple assembly is approximately within 70 to 110 degrees of the center axis of the upper carriage assembly.

9. The grappling carriage as recited in claim 6 whereby a locking linkage is adapted to lock the position of the grapple assembly with respect to the upper carriage assembly in a stored position.

10. The grappling carriage as recited in claim 9 whereby the combined center gravity of the upper carriage assembly and the grapple assembly is positioned in a manner to maintain the upper carriage assembly in a substantially upright manner.

11. The grappling carriage as recited in claim 1 whereby the upper carriage assembly is adapted to have cables from a cabling topography attach thereto to allow the grapple assembly to freely rotate thereunder.

12. The grappling carriage as recited in claim 1 whereby the control system has a conductive line in electric communication with a control line that is adapted to adjust the first and second grapple legs and the rotation of the grapple assembly where said conductor is in communication with a solenoid that operates the throttle of the engine to increase the power of the engine either the first and second grapple legs or the actuator rotating the grapple assembly is in use.

13. The grappling carriage as recited in claim 1 where the control system is adapted to receive signals from more than one operator to control the first and second grapple legs and rotation of the grapple assembly.

14. A grappling carriage adapted to be run by an operator and lift and reposition a log in a logging operation from the field to a landing area, the grappling carriage comprising:

a. an upper carriage assembly comprising:
   i. an engine system having a fuel supply,
   ii. a hydraulic drive system operatively connected to the engine system and comprising hydraulic lines adapted to have pressurized hydraulic fluid pass therethrough, b. a grapple assembly comprising first and second grapple legs having interior surfaces adapted to engage the log in a logging operation, first and second grapple legs pivotally connected to a grapple body of the grapple assembly, the grapple assembly having a center of gravity positioned under a pivot pin attaching the grapple assembly to the upper carriage assembly and the grapple assembly operatively configured to rotate about a center axis and the grapple assembly further comprising:

i. an actuating system comprising actuators adapted to forcefully position the first and second grapple legs to an open position and forcefully position the first and second grapple legs to a closed position, ii. a rotating actuator adapted to rotate the grapple body with respect to the upper carriage assembly, c. a control system adapted to receive signals from the operator to adjust the first and second grapple legs and rotation of the grapple assembly with respect to the upper carriage assembly, d. whereas the center axis of the grapple assembly is positioned between the first and second grapple legs during rotation of the first and second grapple legs.

15. The grappling carriage as recited in claim 14 whereby the actuating system comprises a first and second actuators independently controlling the first and second grapple arms respectively.

16. The grappling carriage as recited in claim 14 whereby the grappling carriage has an operating orientation where the grapple assembly is positioned directly under the upper carriage assembly and the grappling carriage has a stored position whereby a center axis of the grapple assembly is non-co-linear to a center axis of the upper carriage assembly.

17. The grappling carriage as recited in claim 16 whereby the center axis of the grappling assembly is substantially orthogonal to the center axis of the upper carriage assembly in the stored position.

18. The grappling carriage as recited in claim 16 whereby when the grappling carriage is in a stored position, the center axis of the grapple assembly is approximately within 70 to 110 degrees of the center axis of the upper carriage assembly.

19. The grappling carriage as recited in claim 16 whereby a locking linkage is adapted to lock the position of the grapple assembly with respect to the upper carriage assembly in a stored position.

20. The grappling carriage as recited in claim 18 whereby the combined center gravity of the upper carriage assembly and the grapple assembly is positioned in a manner to maintain the upper carriage assembly in a substantially upright manner.

21. A method of extracting logs from a logging site to a landing the method comprising:

a. positioning a grappling carriage having an upper carriage assembly comprising pulley location points and an engine system having a fuel supply, and a hydraulic drive system operatively connected to the engine system and comprising hydraulic lines adapted to have pressurized hydraulic fluid pass therethrough, above a log to be transported, b. orientating first and second grapple legs of a grapple assembly fixedly positioned substantially under and between the pulley location points of the grappling carriage, where a rotating actuator is provided to rotate a grapple body with respect to the upper carriage assembly where a center axis of the grapple assembly is positioned between the first and second grapple legs during rotation of the grapple assembly, and engaging interior surfaces of the first and second grapple legs to the log, where the first and second grapple legs pivotally connected to a grapple body of the grapple assembly, and an actuating system comprising actuators adapted to forcefully position the first and second grapple to an open position and to a closed position around the log for transport, c. manipulating main line and haul back cables that are cooperatively used to position and support the grappling carriage to position the grappling carriage with the log to the landing;

d. where as a remote control system adapted to receive signals from an operator to adjust the first and second grapple legs and rotation of the grapple assembly with respect to the upper carriage assembly, and the grapple assembly having a center of gravity positioned under a pivot pin attaching the grapple assembly to the upper carriage assembly and the grapple assembly.

22. The method as recited in claim 21 where the grapple assembly can rotate with respect to the upper carriage which remains substantially positionally orientated with the supporting cables.

23. The method as recited in claim 21 whereby the grappling carriage is positioned from an operating orientation where the grapple assembly is positioned directly under the upper carriage assembly to a stored position following a logging operation whereby a center axis of the grapple assembly is non-co-linear to a center axis of the upper carriage assembly.

24. The method as recited in claim 23 whereby the center axis of the grappling assembly is substantially orthogonal to the center axis of the upper carriage assembly in the stored position.

25. The method as recited in claim 23 whereby when the grappling carriage is in a stored position, the center axis of the grapple assembly is approximately within 70 to 110 degrees of the center axis of the upper carriage assembly.

26. The method as recited in claim 23 whereby a locking linkage is positioned in a manner to lock the position of the grapple assembly with respect to the upper carriage assembly in a stored position.

27. The method as recited in claim 26 whereby the grapple assembly is positioned in a storage position and placed on a transport and the combined center gravity of the upper carriage assembly and the grapple assembly is positioned in a manner to maintain the upper carriage assembly in a substantially upright manner.

28. The method as recited in claim 21 where the method of extracting logs includes using the grappling carriage that is sufficiently lightweight to operate in logging cable topographies comprised from one or more of either a haul back, skyline or running skyline arrangement.

29. The method as recited in claim 28 whereby the grappling carriage is positioned from an operating orientation where the grapple assembly is positioned directly under the upper carriage assembly to a stored position following a logging operation whereby a center axis of the grapple assembly is non-co-linear and within 70 to 110 degrees to a center axis of the upper carriage assembly.

* * * * *